United States Patent [19]

Onishi et al.

[11] 4,268,461

[45] May 19, 1981

[54] TEMPERATURE COMPENSATING FLOAT ARM FOR USE IN CARBURETORS

[75] Inventors: Shigeru Onishi, Kanazawa; Satoshi Kato, Ibaragi, both of Japan

[73] Assignee: Nippon Clean Engine Laboratory Co., Japan

[21] Appl. No.: 110,370

[22] Filed: Jan. 8, 1980

[30] Foreign Application Priority Data

Jan. 14, 1979 [JP] Japan ..... 54-3486[U]

[51] Int. Cl.[3] ..... F02M 5/12

[52] U.S. Cl. ..... 261/39 B; 137/80; 137/389; 261/70

[58] Field of Search ..... 261/70, 39 B; 137/80, 137/389

[56] References Cited

U.S. PATENT DOCUMENTS

| | | | |
|---|---|---|---|
| 1,712,460 | 5/1929 | Purdy et al. | 261/70 |
| 1,817,069 | 8/1931 | Dickey | 261/70 |
| 2,518,339 | 8/1950 | Landon | 137/389 |
| 2,564,295 | 8/1951 | Benz et al. | 137/80 |
| 2,685,862 | 8/1954 | Hill et al. | 137/389 |
| 2,909,042 | 10/1959 | Long | 137/80 |
| 3,196,899 | 7/1965 | Lattemann | 137/389 |

*Primary Examiner*—Tim R. Miles

*Attorney, Agent, or Firm*—Steinberg & Raskin

[57] ABSTRACT

An arm operatively interconnecting the float and float valve in a carburetor adapted to compensate for changes in ambient temperature to adjust the air-fuel ratio thereof includes a first arm portion having one end operatively associated with the float and a second arm portion of substantially arcuate configuration fixed to or integral with said first arm portion operatively associated with the float valve, the first and second arm portions being substantially entirely formed of a bimetallic construction.

4 Claims, 7 Drawing Figures

FIG. 1
PRIOR ART
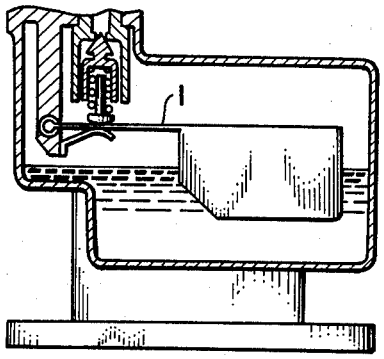
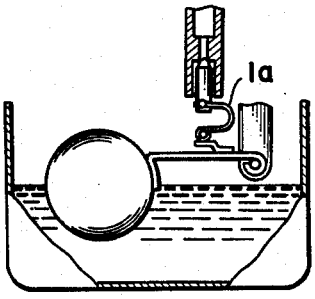
FIG. 2
PRIOR ART
FIG. 3
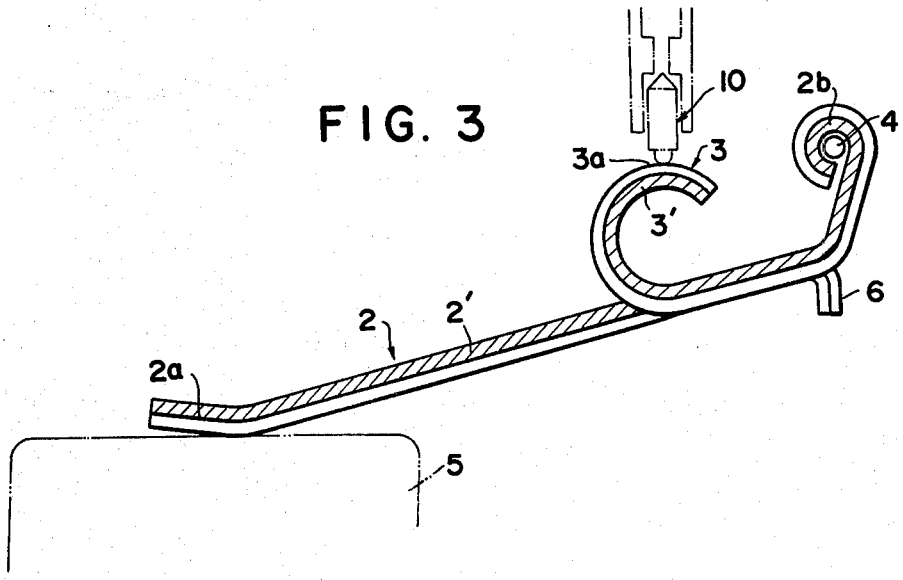

TEMPERATURE COMPENSATING FLOAT ARM FOR USE IN CARBURETORS

BACKGROUND OF THE INVENTION

The present invention relates generally to carburetors for internal combustion engines and, more particularly, to an improvement in float arms of the type utilizing bimetallic construction for varying the level of fuel in the float chamber in accordance with changes in the ambient temperature to change the air-fuel ratio to comply with engine demand.

Generally, it is known that the air-fuel mixture provided by a carburetor becomes richer as the ambient temperature is increased. In order to compensate for this undesired enrichment of the air-fuel mixture, it has been proposed and it is known to adjust the level of fuel in the float chamber of the carburetor in accordance with the change in the ambient air temperature. A float monitors the fuel level in the float chamber and is operatively connected to the float valve by a float arm so that adjustments in the fuel level will correspondingly adjust the air-fuel mixture.

In the past, it has been attempted to form the float arm to incorporate a bimetallic construction. Two examples of such prior constructions are illustrated in FIGS. 1 and 2. Such prior float arms which incorporate a bimetallic construction, however, have not been put into practical use for several reasons.

Thus, it has not been possible to obtain a sufficiently large variation of the fuel level in the float chamber with the known constructions of the float arm. More particularly, in order to obtain a sufficiently large variation of the fuel level in the float chamber, it has been necessary to reduce the thickness of the bimetallic arm which inconveniently but necessarily reduces the rigidity of the float arm to an impractically low level.

For instance, in the case of the prior art construction shown in FIG. 1, the float arm 1 is constituted by a bimetallic construction, i.e., of two strips of different metals or alloys fused to each other. However, as noted above, it is necessary to reduce the relative thickness of the bimetal portion in order to obtain a large effective deflection of the bimetal by providing a large effective length of the bimetal portion. As a consequence, the rigidity of the arm is reduced to such an extent that the arm is unusable. In addition, a lateral pressure is exerted on the float valve by the deviation of the float arm which hinders the correct operation of the float valve.

In the prior art construction shown in FIG. 2, only the float-valve actuating portion 1*a* of the float arm is formed of a bimetallic construction. Such construction, however, can provide only a small displacement of the float valve, so that it is necessary to again reduce the relative thickness of the bimetal, resulting in an impractically reduced rigidity of the arm as a whole.

SUMMARY OF THE INVENTION

Accordingly, one object of the present invention is to provide a new and improved float arm in a carburetor which is capable of producing a sufficiently large variation of the fuel level in the float chamber in accordance with the change in the ambient temperature.

It is another object of the invention to provide a new and improved float arm in a carburetor formed of a bimetallic construction which has a practically acceptable strength.

It is still another object of the invention to provide a new and improved float arm in a carburetor capable of insuring a reliable operation of the float valve in response to changes in the ambient air temperature.

It is a further object of the invention to provide a new and improved float arm in a carburetor having a simple construction and a high utility.

Briefly, in accordance with the present invention, these and other objects are attained by providing a float arm for a carburetor for internal combustion engines, the carburetor having a float valve operatively connected to a float, the float arm being characterized by a first arm portion adapted to operate in association with the float, and a second arm portion securely fixed to the first arm portion and adapted to operate in association with the float valve, wherein the second arm portion has an arcuate configuration and wherein the first and second arm portions are substantially entirely constituted by a bimetallic construction.

In a preferred form of the invention, the first arm portion is fixed to the float of the carburetor and is provided at its other end with retaining means by which the float arm is retained on a pin which constitutes the pivot point or fulcrum of the float arm.

BRIEF DESCRIPTION OF THE DRAWINGS

A more complete appreciation of the present invention and many of the attendant advantages thereof will bereadily appreciated as the same becomes better understood by reference to the following detailed description when considered in connection with the accompanying drawings in which:

FIG. 1 is a front elevation view in partial section illustrating an example of a prior art float arm;

FIG. 2 is a front elevation view in partial section illustrating another example of a prior art float arm;

FIG. 3 is an elevation view of one embodiment of the float arm of the present invention with the float and float valve illustrated in phantom;

DESCRIPTION OF THE PREFERRED EMBODIMENTS

Figure 4:
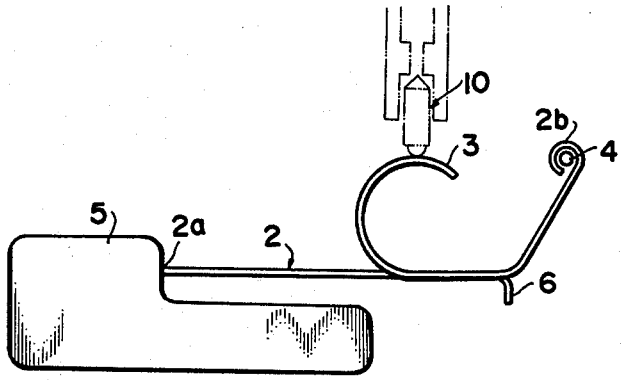
FIG. 4 is an elevation view of another embodiment of the float arm of the present invention in cooperation with the float and with the float valve illustrated in phantom.

The invention will be more fully understood from the following description of preferred embodiments taken in conjunction with the accompanying drawings.

Referring first to FIG. 3, the float arm of the present invention includes a first arm portion 2, which is adapted to operatively contact a float 5 in a float chamber of a carburetor. The first arm portion 2 is provided at one end with a float acting portion 2*a* and at its other end with a retaining portion 2*b* adapted to be retained by a pivot or fulcrum 4, e.g., a pin formed on a bracket provided in the float chamber or the like, which pin functions as the pivot or fulcrum for the float arm of the present invention. The first arm portion 2 has a substantially L-shaped configuration as illustrated. A second arm portion 3 which is adapted to act on the float valve 10 disposed in the float chamber as illustrated is securely fixed to the first arm portion 2. The second arm portion 3 has a substantially arcuate configuration as illustrated, with the arcuate surface 3*a* being in contact with the float valve 10. It is quite important to form the second arm 3 in arcuate shape in the present invention for reasons which will be made clear hereinbelow.

The first and second arm portions 2, 3 are substantially entirely constituted by a bimetallic construction. More specifically, the first arm portion 2 is constituted by a bimetallic construction comprising an upper metal strip 2' and a lower strip formed of a metal having a different coefficient of thermal expansion fused thereto. The upper metal 2' as seen in the drawing, i.e., the one on the other side of the metal which is in contact with the float, has a greater coefficient of thermal expansion than the lower metal. The second arm 3 has a bimetallic construction wherein the inner metal 3' of the arc as seen in the drawing has the greater coefficient of thermal expansion. Any known materials can be used as the materials of the bimetals constituting the first and second arm portions 2, 3.

A stopper 6 is provided which is adapted to abut against an abutment (not shown) to thereby limit the extent of displacement of the float arm to insure that the change of the fuel level in the float chamber is maintained within a predetermined range.

FIG. 4 illustrates another embodiment of the present invention in which the float acting portion 2*a* of the first arm portion 2 is fixed to the float 5. Other portions of the float arm are similar to those shown in FIG. 3 so that the same reference numerals are used to denote the same or corresponding members or parts to those of FIG. 3 and the detailed description of these members or parts is omitted here. In this embodiment, substantially the entire float arm has a bimetallic construction as is the case of the embodiment illustrated in FIG. 3.

In the manufacture of the float in accordance with the invention, a higher precision is obtained if the two arm portions are integrally formed from a common bimetal material. However, it is understood that it is possible to fabricate the first arm portion 2 and the second arm portion 3 separately with the arm portions being subsequently fixed to each other by conventional means, such as by welding.

Figure 5:
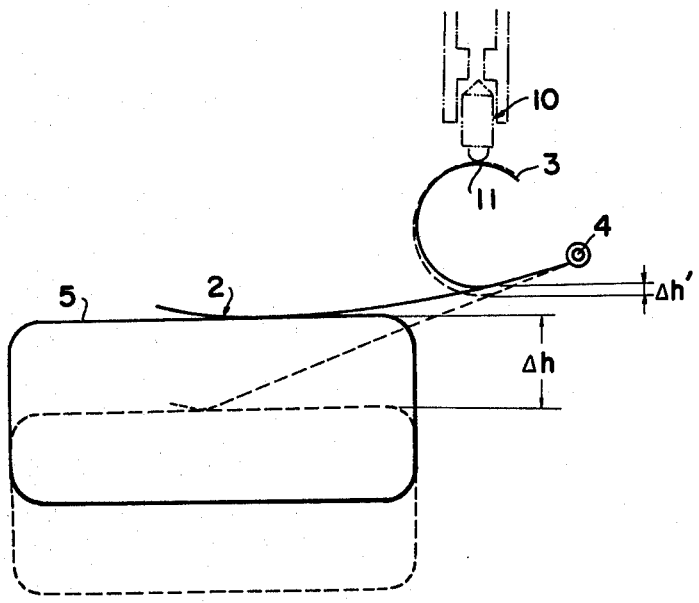
FIG. 5 is a schematic illustration of the operation of a float arm constructed in accordance with the present invention.

The operation of the float arm in accordance with the invention will now be described. Referring to FIG. 5, as the ambient temperature in the float chamber is increased, the first arm portion 2 is deflected downwardly as shown by the broken line, while the second arm portion 3 is deflected in a manner such that the radius of the arc is increased so that the float valve 10 is moved upwardly from the dotted line position to the solid line position as seen in FIG. 5. As a result, the level of fuel in the float chamber is lowered by an amount designated $\Delta$ h and a compensation of $\Delta$ h' is made for the float valve 10.

On the other hand, as the ambient temperature is lowered, the arm portions are deflected in a reverse manner to that described above so that the level of fuel in the float chamber is raised.

It is to be noted that since the portion 11 of the second arm portion 3 which contacts the float valve 10 has an arcuate surface 3*a* as seen in FIG. 3, the float valve 10 is always urged in only its axial direction irrespective of the extent of the deviation of the second arm portion 3. Consequently, substantially no lateral pressure is applied to the float valve 10, thereby insuring a smooth and reliable operation of the float valve in response to the change in the temperature.

Figure 6:
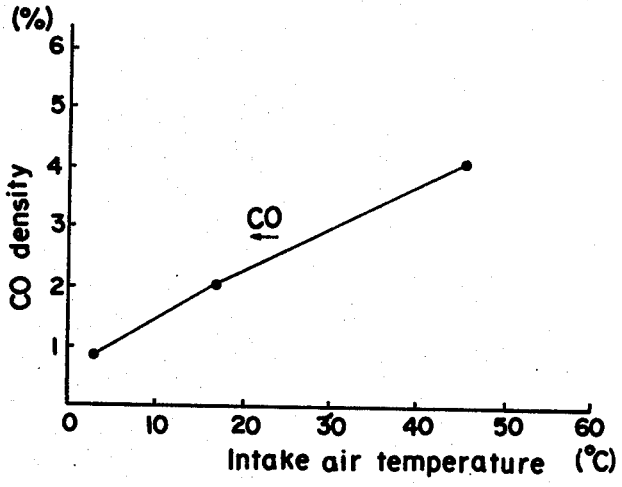
FIG. 6 is a graph showing the relationship between the intake air temperature and the CO density in the exhaust gas as observed in an internal combustion engine having a conventional carburetor.

FIG. 6 graphically illustrates the relationship between the intake air temperature (abscissa) which constitutes the ambient temperature in the carburetor and the CO density in the exhaust gas (ordinate) as observed during operation of an internal combustion engine having a carburetor incorporating a float arm constructed according to the prior art. It will be seen from this figure that the CO density increases as the intake air temperature is raised. This results in the air-fuel mixture being enriched as the intake air temperature is raised. On the other hand, a decrease in the intake air temperature results in the air-fuel mixture becoming leaner to lower the CO density. In this case, the engine operation is rendered unstable due to the mixture being made too lean.

Figure 7:
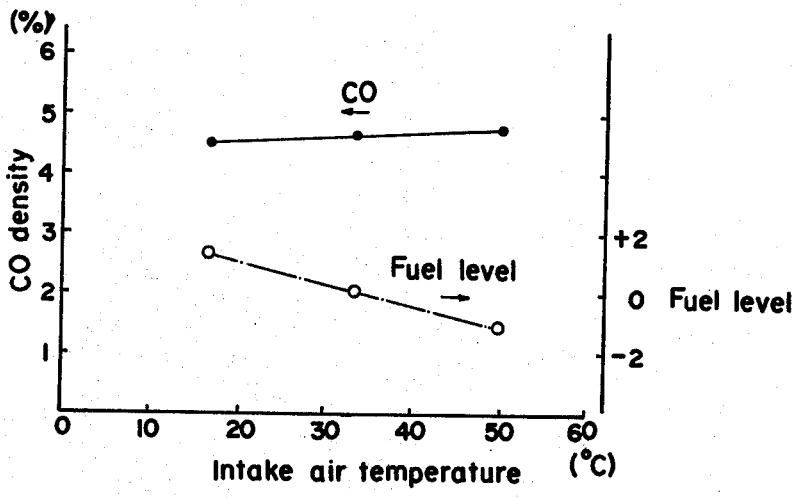
FIG. 7 is a graph showing the relationship between the intake air temperature and the CO density in the exhaust gas as well as the fuel level in the float chamber as observed in an internal combustion engine having a carburetor incorporating a float arm of the present invention.

FIG. 7 graphically illustrates the relationship between the intake air temperature (abscissa) and the CO density in the exhaust gas (left ordinate) as obtained with a carburetor incorporating the float arm of the present invention. The right ordinate indicates the change of the fuel level in the float chamber. It will be seen that the use of the float arm of the invention results in the CO density in the exhaust gas being maintained substantially constant even when the intake air temperature is changed, since the fuel level is changed in response to the change in the intake air temperature. This means that the air-fuel ratio of the mixture is maintained substantially constant.

Further, it is possible to supply rich and lean mixtures in the winter and summer seasons, respectively.

According to the invention, since the float arm as a whole exhibits a large displacement which is the sum of the displacements of the first and second arm portions, it is possible to obtain a sufficiently large change of the fuel level in the float chamber in response to the change in the ambient air temperature, so that the air-fuel ratio is maintained within a suitable range to insure a stable operation of the engine irrespective of the change in the ambient temperature. Further, the float arm of the invention permits the engine to operate in a stable manner with a lean mixture which in turn contributes to the prevention of air pollution as well as a savings of fuel. In addition, since the sum of the displacements of the first and second float arm portions is utilized, it is possible to maintain the thickness of the bimetal at a comparatively high level of about 0.2 to 0.5 millimeters which in turn provides a sufficient strength to allow its use in practical applications. Thus, the invention provides a float arm which simultaneously achieves sufficient strength and superior performance. Further, it is to be noted that the arcuate configuration of the second arm portion eliminates the lateral pressure applied to the float valve by conventional float arm constructions, thereby insuring an extremely superior operation of the float valve.

Obviously, numerous modifications and variations of the present invention are possible in the light of the above teachings. It is therefore to be understood that within the scope of the appended claims, the invention may be practiced otherwise than as specifically disclosed herein.

What is claimed is:

1. A float arm for use in a carburetor for internal combustion engines, the carburetor having a float valve and a float operatively interconnected thereto by said float arm, comprising:

an elongate first arm portion having one end adapted to be operatively associated with said float;

a second arm portion fixed to said first arm portion and adapted to be operatively associated with said float valve; and wherein said second arm portion has a substantially arcuate configuration and wherein said first and second arm portions are substantially entirely formed of a bimetallic construction.

2. A float arm as claimed in claim 1, wherein said one end of said first float arm portion is fixed to said float.

3. A float arm as claimed in claim 1, wherein the other end of said first arm portion has retaining means provided thereon adapted to retain said float arm portion on a fulcrum for said float arm.

4. A float arm as claimed in claim 1, wherein said arcuate second arm portion has inner and outer surfaces formed of materials having greater and lesser coefficients of thermal expansion, respectively, and wherein said outer surface of said second arm portion is adapted to engage said float valve.

* * * * *